United States Patent [19]

Christ

[11] 4,456,183

[45] Jun. 26, 1984

[54] FIBERIZER FOR STOCK SUSPENSIONS FOR FABRICATING PAPER

[75] Inventor: Alfred Christ, Zürich, Switzerland

[73] Assignee: Escher Wyss GmbH, Ravensburg, Fed. Rep. of Germany

[21] Appl. No.: 353,643

[22] Filed: Mar. 1, 1982

[30] Foreign Application Priority Data

Mar. 23, 1981 [CH] Switzerland ..... 1933/81

[51] Int. Cl.[3] ..... B02C 23/36

[52] U.S. Cl. ..... 241/46.17; 241/69; 241/82

[58] Field of Search ..... 241/46.17, 82, 46.11, 241/70, 69, 278 R, 46.02, 73

[56] References Cited

U.S. PATENT DOCUMENTS 3,525,477 8/1970 Kobayashi ..... 241/82 X 3,942,728 3/1976 Christ et al. ..... 241/46.17

FOREIGN PATENT DOCUMENTS 2658845 6/1978 Fed. Rep. of Germany .

2757581 5/1979 Fed. Rep. of Germany .

*Primary Examiner*—Mark Rosenbaum

*Assistant Examiner*—Joseph M. Gorski

*Attorney, Agent, or Firm*—Werner W. Kleeman

[57] ABSTRACT

A fiberizer contains a housing having a circumferential jacket in the form of a body of rotation at one end or end portion of which there is located a screen or sieve. At an end wall of the housing opposite the screen there are arranged guide elements which protrude into the internal chamber or compartment of the housing. Within the housing there is located a rotor having arms which are movable along the screen.

8 Claims, 2 Drawing Figures

FIBERIZER FOR STOCK SUSPENSIONS FOR FABRICATING PAPER

BACKGROUND OF THE INVENTION

The present invention relates to a new and improved construction of fiberizer—also sometimes referred to as a stock pulper—for stock suspensions for fabrication of paper.

Generally speaking, the fiberizer or stock pulper of the present development is of the type comprising a closed housing possessing a circumferential jacket or wall in the form of a body of rotation. At one end of the housing there is arranged a screen or sieve. The housing is equipped with a device for imparting a rotational movement to the stock suspension within the housing about the lengthwise axis of such housing.

Fiberizers or stock pulpers of the aforementioned type are known in the art, as exemplified, by way of example, from U.S. Pat. No. 3,942,728, granted Mar. 9, 1976, U.S. Pat. No. 3,945,576, granted Mar. 23, 1976, U.S. Pat. No. 4,135,671, granted Jan. 23, 1979 and German Patent Publication No. 2,757,581. Even though the state-of-the-art fiberizers of such type operate in a satisfactory fashion, nonetheless it has been found that through the use of simple means it is possible to achieve a further improvement in their mode of operation, especially an increase in their efficiency.

SUMMARY OF THE INVENTION

Therefore, with the foregoing in mind it is a primary object of the present invention to provide an improved construction of fiberizer which fulfils the aforementioned objective, and specifically increases the efficiency of the fiberizer and avoids heretofore undetected losses arising during operation of the fiberizer.

Another important object of the present invention is directed to a new and improved construction of fiberizer which is relatively simple in design, extremely economical to manufacture, highly reliable in operation, not readily subject to breakdown or malfunction, and requires a minimum of maintenance and servicing.

Yet a still further object of the invention is to devise a new and improved construction of fiberizer or stock pulper which contains means improving the operation and efficiency of the fiberizer during the stock pulping and sorting functions.

Another extremely important object of the present invention is the provision of a fiberizer constructed with means which minimize the undesired backflow of good stock from a good stock chamber into the internal chamber or compartment of the fiberizer where there should be eliminated the rejects.

Now in order to implement these and still further objects of the invention, which will become more readily apparent as the description proceeds, the fiberizer of the present development is manifested by the features that the end wall of the housing located opposite or remote from the screen or sieve is provided with guide elements, for instance in the form of sheet metal guides, which are arranged transversely with respect to the tangential circumferential direction of the housing, these guide elements protruding into the internal chamber or compartment of such housing.

It has been found that with equipment of this type there occurs an undesirable back or return flow of good stock from a good stock chamber through the screen plate or screen into the internal chamber of the housing.

In fact, this undesirable return or backflow is more intense in the case of large diameter fiberizers. This return flow reduces the overall value of the stock throughput processed by the fiberizer and thus its efficiency which is dependent thereon. The guide elements contemplated by the invention bring about a braking of the turbulent flow within the vortex core or the like at the central region of the housing. As a result there increases the pressure prevailing at the central region of the screen or sieve. Any possibly present negative pressure can be converted into an excess or positive pressure, whereby there can be beneficially avoided the aforementioned return or backflow. The separation function for possibly present heavy rejects or contraries, accomplished by the action of the centrifugal force, is maintained practically without any disturbance.

Within the container there can be arranged a rotor which has arms or arm members movable along or over the screen or sieve. On the one hand, such rotor exerts a cleaning action upon the screen and, on the other hand, it accomplishes a comminution and defiberizing of not yet fully defiberized pieces of waste paper in the event that such have been inputted to the fiberizer. At the same time the rotor also can impart the desired rotational movement to the stock suspension within the housing. However, it is to be clearly understood that also other means can be employed for imposing a rotational movement upon the stock suspension, as for instance providing a tangential inflow or infeed arrangement for the stock suspension which is infed at a high velocity.

Preferably, the guide elements can be essentially linear guide elements and radially arranged within the housing. This leads to a particularly simple construction of the guide elements which may possess the form of simple rib members. However, the guide elements also could possess a different configuration and/or arrangement, for instance could be curved, inclined or arranged at a certain spacing from the housing wall.

Advantageously, the circumferential jacket or shell of the housing can possess an essentially conical shape which widens with increasing spacing from the screen or sieve—also sometimes referred to as a screen plate—and possesses a smooth surface at the inner housing or jacket wall. Additionally, at the end of the circumferential jacket of the housing which is remote from the screen or screen plate there is arranged an outfeed or outlet line for heavy rejects or contraries.

By virtue of these measures there is beneficially realized an extensively unhindered separation of the heavy rejects notwithstanding the braking of the turbulent flow within the housing which is brought about by the guide elements. The heavy rejects, which bear under the action of the centrifugal force at the smooth inner surface or wall of the circumferential jacket of the housing, can move along such smooth inner wall surface without being hindered and reach the outlet for such heavy rejects, where they are then purged from the fiberizer. The braking of the turbulent flow by the guide elements therefore does not have any detrimental effect upon the elimination of such heavy rejects.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
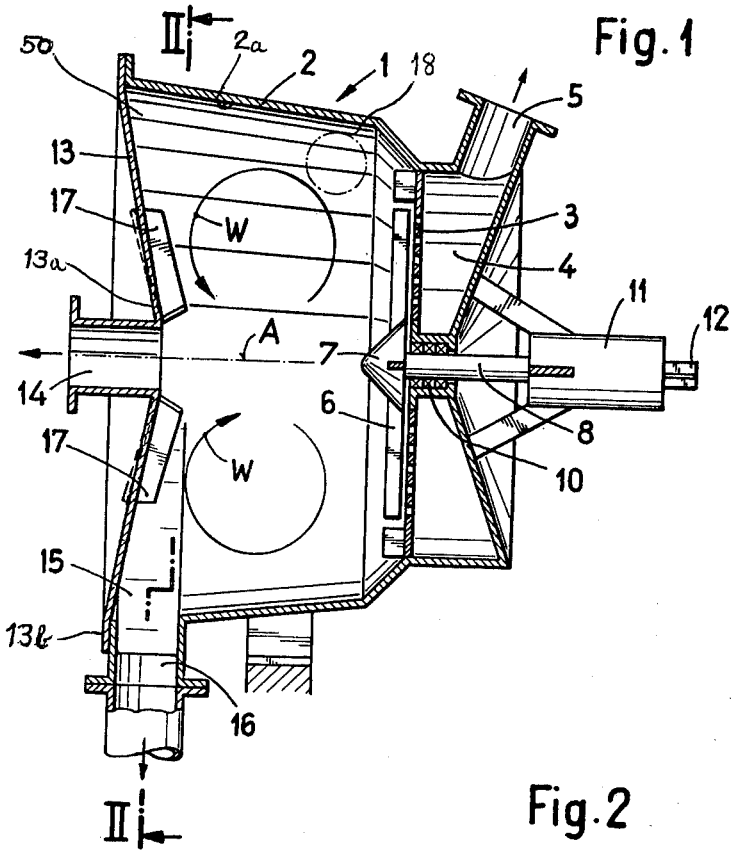
FIG. 1 is an axial sectional view of a fiberizer constructed according to the invention.
Figure 2:
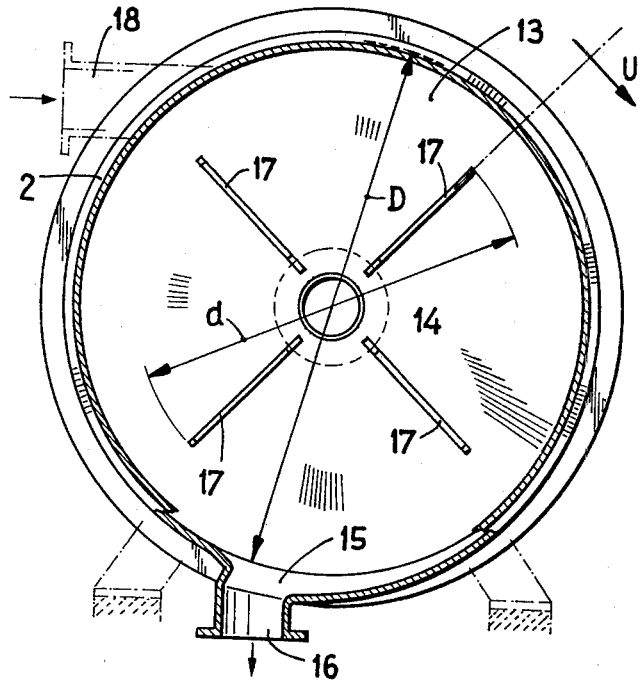
FIG. 2 is a sectional view of the fiberizer shown in FIG. 1, taken substantially along the line II—II thereof.

Describing now the drawings, the fiberizer or stock pulper for pulping and sorting waste paper as has been illustrated by way of example in FIGS. 1 and 2 generally is of the type disclosed in the aforementioned U.S. Pat. No. 3,942,728. This fiberizer contains a housing 1 possessing a circumferential jacket or shell 2 in the form of a body of rotation, at the one end of which there is arranged a screen or sieve 3 in the form of a perforated screen plate, for instance formed of sheet metal by way of example. A good stock chamber 4 having an outlet line or conduit 5 for good stock merges in flow communication with the screen plate or screen 3. Movable along the screen 3 are the arm members 6 of a rotor 7 which is attached to a drive shaft 8. This drive shaft 8 piercingly extends through a suitable seal 10 and is rotatably mounted in a bearing housing 11. By means of the shaft journal 12 it is possible to drivingly connect the shaft 8 with any suitable motor drive or drive means.

An end wall 13 of the housing 1 is located opposite or remote from the screen 3. This end wall 13 can be constructed as a detachable cover member and can possess a slightly conical shape having a cone apex portion 13*a* directed towards the interior space or chamber 50 of the housing 1. Along the lengthwise axis A of the housing 1 the housing end wall 13 is provided with an outlet stud or connection 14 for the light contaminants or contraries, such as for instance foil pieces, which tend to collect at the turbulence or vortex core of the stock suspension located within the housing 1.

At the outer circumference of the housing 1 at the end of the circumferential jacket or shell 2 remote from the screen plate or screen 3 there is located a catch or receiving pocket or opening 15 equipped with an outlet or outfeed line or conduit 16 for the heavy rejects or contraries which have been eliminated from the stock suspension.

As also will be seen by inspecting FIGS. 1 and 2, in accordance with the invention the end wall 13 of the housing 2 is importantly provided with guide means, here the guide elements 17, for instance sheet metal guides by way of example and not limitation, which protrude into the internal space or chamber 50 of the housing 1. These guide elements or guides 17 are generally arranged transversely with respect to the tangential circumferential direction U, and preferably radially within the housing 1, as best seen by referring to FIG. 2.

As also has been shown with phantom lines in both FIGS. 1 and 2 the housing 1 is equipped with a tangentially arranged inlet channel or connection 18 for the infeed of the stock suspension or the like which is to be processed in the fiberizer.

During operation of the fiberizer and due to the rotational movement of the driven rotor 7 the contents of the housing 1, namely the stock suspension which is to be pulped and sorted, is placed into a turbulent movement about the lengthwise axis A of the housing 1, while simultaneously undergoing a circulatory movement in the sense of the indicated curved arrows W illustrated in FIG. 1. At the outer region of the housing 1 the turbulent movement about the axis A initiates a propelling out of the heavy rejects or constituents from the stock suspension and these are then entrapped in the pocket or opening 15 and ultimately withdrawn from the fiberizer through the outlet or outfeed line 16. However, the presence of an intensified turbulent movement simultaneously causes the formation of a suction action at the axial region of the screen or sieve 3, so that there is caused a partial back or return flow of good stock out of the good stock chamber or collecting region 4.

However, by virtue of the provision of the guide elements 17, as contemplated by the invention, there is initiated, on the one hand a braking of the turbulent flow about the lengthwise axis A of the housing 1 at the region of the end wall 13 and at the central region of the housing 1. On the other hand, the circulatory motion in the sense of the arrow W is not hindered or impaired. Consequently, there occurs an increase in the pressure at the central region of the screen 3, so that there is augmented the outflow at this region into the good stock chamber 4 and there is beneficially avoided any back or return flow out of such good stock chamber 4.

As already mentioned, there is not hindered the elimination of heavy rejects or contraries, since as soon as they are propelled against the inner wall 2*a* of the circumferential jacket 2 of the housing 1, these heavy rejects move along the smooth surface of this inner housing wall 2*a*, which as will be recalled possesses an outwardly tapered or flaring configuration with increasing distance from the screen plate 3, and then ultimately arrive at the catch pocket 15 where they are then expelled through the heavy reject outlet 16. The braking of the turbulent flow does not have any disadvantageous action upon such heavy rejects.

This effect is further augmented in that, as particularly well seen by inspecting FIG. 2, the guide elements 17 do not extend up to the outer edge 13*b* of the end wall 13, rather only extend up to a diameter d which at most amounts to 0.8-fold of the largest internal diameter D of the housing 1.

By virtue of the inventive construction of fiberizer there is achieved the noteworthy beneficial result that the braking of the turbulent flow first occurs at the proximity of the central vortex or turbulent core, whereas the external flow at the region of the circumferential jacket 2 of the housing 1 remains essentially unbraked.

While there are shown and described present preferred embodiments of the invention, it is to be distinctly understood that the invention is not limited thereto, but may be otherwise variously embodied and practiced within the scope of the following claims.

Accordingly, what I claim is:

1. A fiberizer for stock suspensions for fabrication of paper, comprising:

a closed housing possessing a circumferential jacket in a form of a body of rotation;

said housing possessing an end portion;

a screen arranged within said housing at a region of said end portion;

means for imparting a rotational movement to a stock suspension contained within an internal chamber of said housing about a lengthwise axis of said housing;

said housing possessing an end wall located remote from said screen;

guide means provided for said end wall of said housing;

said guide means being arranged transversely with respect to a tangential circumferential direction of the housing and protruding into the internal chamber of said housing;

said end wall is located opposite said screen;

said guide means are mounted at said oppositely located end wall and extend radially with respect to said end wall and said lengthwise axis of the housing;

said housing defines a good stock chamber at an end region thereof located remote from said end wall;

said good stock chamber being located at a side of said screen which faces away from said end wall; and said guide means inhibiting return flow of good stock from said good stock chamber through said screen.

2. The fiberizer as defined in claim 1, wherein:

said guide means comprise guide elements.

3. The fiberizer as defined in claim 2, wherein:

said guide elements comprise sheet metal guides.

4. The fiberizer as defined in claim 2, wherein:

said means for imparting a rotational movement to the stock suspension comprises a rotor having rotor arms movable along said screen.

5. The fiberizer as defined in claim 4, wherein:

said guide elements are arranged essentially linearly and radially in said housing.

6. The fiberizer as defined in claim 2, wherein:

said guide elements are arranged essentially linearly and radially in said housing.

7. The fiberizer as defined in claim 2, wherein:

said guide elements extend along a diameter which amounts to at most 0.8-fold of the largest internal diameter of said housing.

8. The fiberizer as defined in claim 1, wherein:

said circumferential jacket of said housing possesses an essentially conical configuration which widens with increasing spacing from said screen;

said circumferential jacket having a smooth inner wall surface; and output line means for heavy rejects arranged at an end region of said circumferential jacket disposed remote from said screen.

* * * * *